US011857015B1

(12) United States Patent
Leung

(10) Patent No.: US 11,857,015 B1
(45) Date of Patent: Jan. 2, 2024

(54) HEAD-MOUNTED TEMPERATURE ADJUSTMENT DEVICE

(71) Applicant: Funsend Technology Co., Limited, Hong Kong (HK)

(72) Inventor: Gwo Leung, Hong Kong (HK)

(73) Assignee: Funsend Technology Co., Limited, Hong Kong (HK)

( * ) Notice: Subject to any disclaimer, the term of this patent is extended or adjusted under 35 U.S.C. 154(b) by 0 days.

(21) Appl. No.: 18/481,184

(22) Filed: Oct. 4, 2023

(30) Foreign Application Priority Data

Aug. 31, 2023 (CN) ..... 202322359198.X

(51) Int. Cl.
*A42B 1/00* (2021.01)
*A42B 1/008* (2021.01)
*A42B 3/28* (2006.01)

(52) U.S. Cl.
CPC ..... *A42B 1/008* (2013.01); *A42B 3/286* (2013.01)

(58) Field of Classification Search
CPC ..... A42B 1/008; A42B 3/286
See application file for complete search history.

(56) References Cited

U.S. PATENT DOCUMENTS 3,881,198 A * 5/1975 Waters ..... A42C 5/04 2/906
4,893,356 A * 1/1990 Waters ..... A42B 1/008 2/909
5,085,231 A * 2/1992 Johnson ..... A42C 5/04 131/331
5,425,620 A * 6/1995 Stroud ..... A42C 5/04 403/360
5,561,862 A * 10/1996 Flores, Sr. ..... A42B 3/286 2/422
6,122,773 A * 9/2000 Katz ..... A42B 3/286 2/422
9,241,529 B1 * 1/2016 Danelski ..... A42B 3/286
11,528,955 B1 * 12/2022 Rodriguez ..... A42B 3/0453
2016/0100647 A1 * 4/2016 Raiffeisen ..... F04D 25/084 2/171.3
2017/0332721 A1 * 11/2017 Otey ..... A42B 3/227
2018/0064199 A1 * 3/2018 Battis ..... A42B 3/283
2019/0150550 A1 * 5/2019 Zoref ..... A42B 3/125
2021/0289874 A1 * 9/2021 Murphy ..... A62B 18/045
2022/0013704 A1 * 1/2022 Chen ..... H10N 10/01
2022/0095736 A1 * 3/2022 Henshaw ..... A62B 18/045
2022/0142283 A1 * 5/2022 Hashimoto ..... A61B 5/14517
2022/0264986 A1 * 8/2022 Walker ..... A42B 1/0181
2023/0256270 A1 * 8/2023 Shoham ..... A42B 1/008 128/200.28

* cited by examiner

*Primary Examiner* — Khaled Annis

(57) ABSTRACT

Disclosed is a head-mounted temperature adjustment device, including a cap body, a temperature conduction sheet, and a temperature adjustment assembly. The temperature adjustment assembly includes a semiconductor temperature adjustment member and a fan, the temperature conduction sheet and the semiconductor temperature adjustment member are thermally conducted and both disposed in the cap body, the temperature conduction sheet is located on a side of the semiconductor temperature adjustment member facing a human head, and the fan is disposed on a side of the semiconductor temperature adjustment member facing away from the human head. In the above solution of the present disclosure, the head-mounted temperature adjustment device can be switched between a cooling mode and a heating mode to warm or cool the human head.

10 Claims, 11 Drawing Sheets

HEAD-MOUNTED TEMPERATURE ADJUSTMENT DEVICE

TECHNICAL FIELD

The present disclosure relates to the technical field of temperature adjustment devices, and in particular, to a head-mounted temperature adjustment device.

BACKGROUND

A cap is a kind of clothing worn on the head, most of which can cover the entire top of the head, and has the functions such as sunshade, decoration, warming and protection. There are many types of caps. In summer, people like to wear sun caps to prevent from sunshine; and in winter, people like to wear thick caps to prevent from wind. However, the existing caps do not have a temperature adjustment function. They cannot cool the head while preventing from sunshine, and cannot provide heat to the head while preventing from wind.

SUMMARY

Therefore, the main technical problem to be solved by the present disclosure is to provide a head-mounted temperature adjustment device that can cool or warm a human body.

To achieve the above purpose, the present disclosure provides the following technical solution.

A head-mounted temperature adjustment device is provided, including a cap body, a temperature conduction sheet, and a temperature adjustment assembly, where the temperature adjustment assembly comprises a semiconductor temperature adjustment member and a fan, the temperature conduction sheet and the semiconductor temperature adjustment member are thermally conducted and both disposed in the cap body, the temperature conduction sheet is located on a side of the semiconductor temperature adjustment member facing a human head, and the fan is disposed on a side of the semiconductor temperature adjustment member facing away from the human head.

Preferably, the temperature adjustment assembly further includes a heat dissipation member, a plurality of heat dissipation fins are formed on the heat dissipation member, the heat dissipation member is disposed on a side of the semiconductor temperature adjustment member facing away from the temperature conduction sheet, and the fan is connected to the heat dissipation member or the cap body.

Preferably, the cap body includes a cap main body, a filling layer and a housing, an avoidance hole configured to accommodate the heat dissipation member is formed in the filling layer, a periphery of the housing and the cap main body are connected to fully enclose the filling layer, the temperature conduction sheet, the semiconductor temperature adjustment member and the heat dissipation member, and a ventilation structure is provided at a position of the housing corresponding to the avoidance hole.

Preferably, the temperature adjustment assembly includes a control circuit board and a battery, and the semiconductor temperature adjustment member, the fan and the battery are electrically connected to the control circuit board, respectively.

Preferably, the cap body further includes a cap peak, the cap peak includes a first peak layer, a second peak layer and a third peak layer, the second peak layer is provided with a limiting hole matched with the battery, and the first peak layer and the third peak layer are connected to fully enclose the second peak layer, the control circuit board and the battery.

Preferably, a charging interface is provided at one end of the control circuit board, the charging interface is located at an edge of the cap peak, and the second peak layer is provided with a limiting gap matched with the charging interface.

Preferably, the filling layer and the housing are both of a breathable structure, or an air inlet groove surrounding the heat dissipation member is formed in one end of the avoidance hole close to the housing.

Preferably, the housing includes a support layer and a breathable layer, the support layer is close to the filling layer relative to the breathable layer, and the breathable layer is locally or entirely of a mesh structure.

Preferably, the temperature conduction sheet extends along a circumferential direction of the cap main body in an arc shape, and abuts against the cap main body.

Preferably, the head-mounted temperature adjustment device further includes a heat insulation member, wherein the heat insulation member is sleeved on a periphery of the semiconductor temperature adjustment member.

In the above solution of the present disclosure, the head-mounted temperature adjustment device can be switched between a cooling mode and a heating mode to warm or cool a human head. When working, the side of a semiconductor temperature adjustment member close to a temperature conduction sheet generates heat or cold and transfers same to the temperature conduction sheet with temperature equalization characteristics, providing uniform cold or heat to the human head and avoiding bad experience of local overcooling or overheating. Specifically, in hot weather, the side of the semiconductor temperature adjustment member facing the human head refrigerates, and evenly transfers the cold to the human head through the temperature conduction sheet to cool the human head, and a fan blows out or extracts the heat generated by the side of the semiconductor temperature adjustment member facing away from the human head to the outside, helping the semiconductor temperature adjustment member to dissipate the heat, such that the semiconductor temperature adjustment member maintains the best cooling effect. In cold weather, the side of the semiconductor temperature adjustment member facing the human head heats, and evenly transfers the heat to the human head through the temperature conduction sheet to warm the human head, and the fan blows out or extracts the cold generated by the side of the semiconductor temperature adjustment member facing away from the human head to the outside, helping the semiconductor temperature adjustment member to dissipate the cold, such that the semiconductor temperature adjustment member maintains the best warming effect. The head-mounted temperature adjustment device of the present disclosure combines a cap body with the temperature conduction sheet and a temperature adjustment assembly, such that people can increase or decrease the temperature of the head while wearing the cap.

REFERENCE NUMERALS

Figure 1:
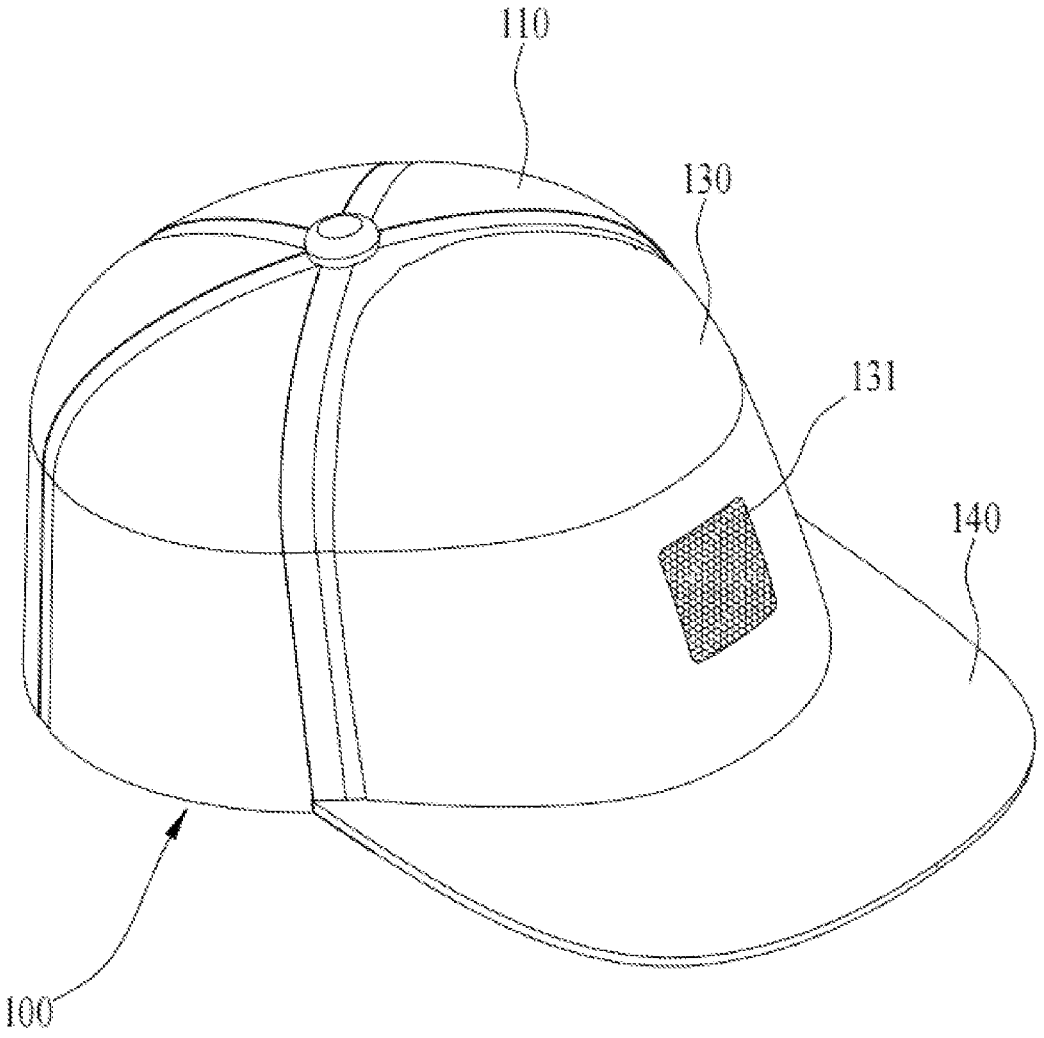
FIG. 1 is a stereogram of a head-mounted temperature adjustment device according to a first embodiment of the present disclosure.
Figure 2:
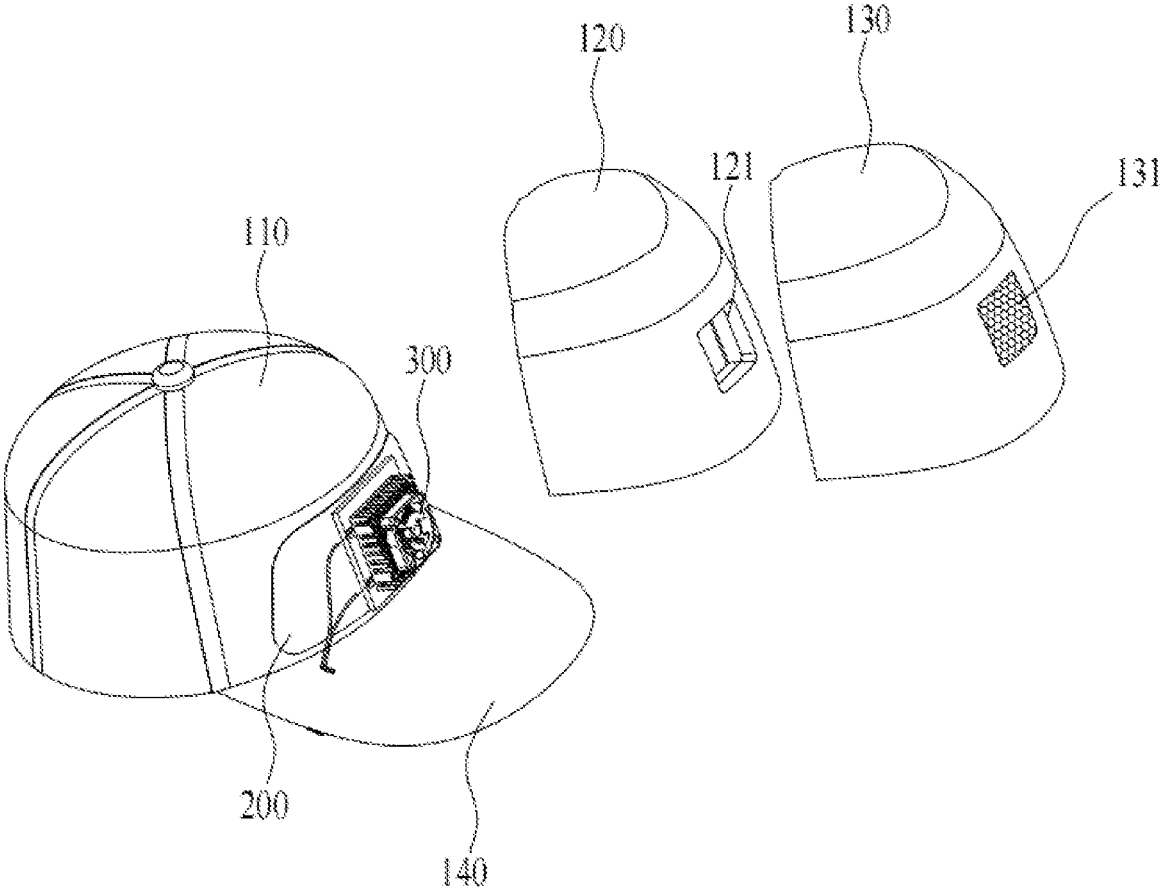
FIG. 2 is a schematic diagram of cap body disassembly of a head-mounted temperature adjustment device according to a first embodiment of the present disclosure.
Figure 3:
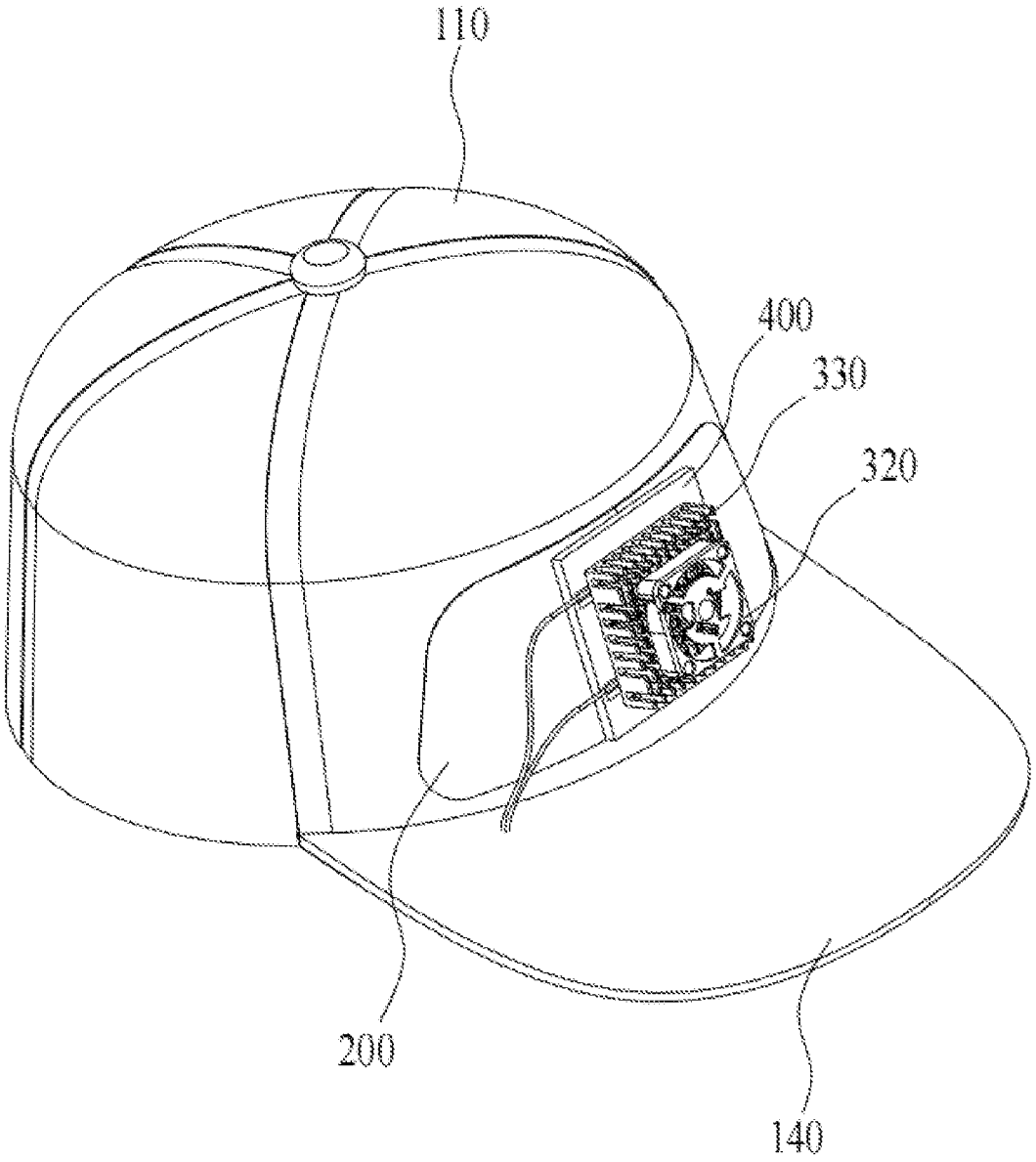
FIG. 3 is a schematic diagram of some structures of a head-mounted temperature adjustment device according to a first embodiment of the present disclosure.
Figure 4:
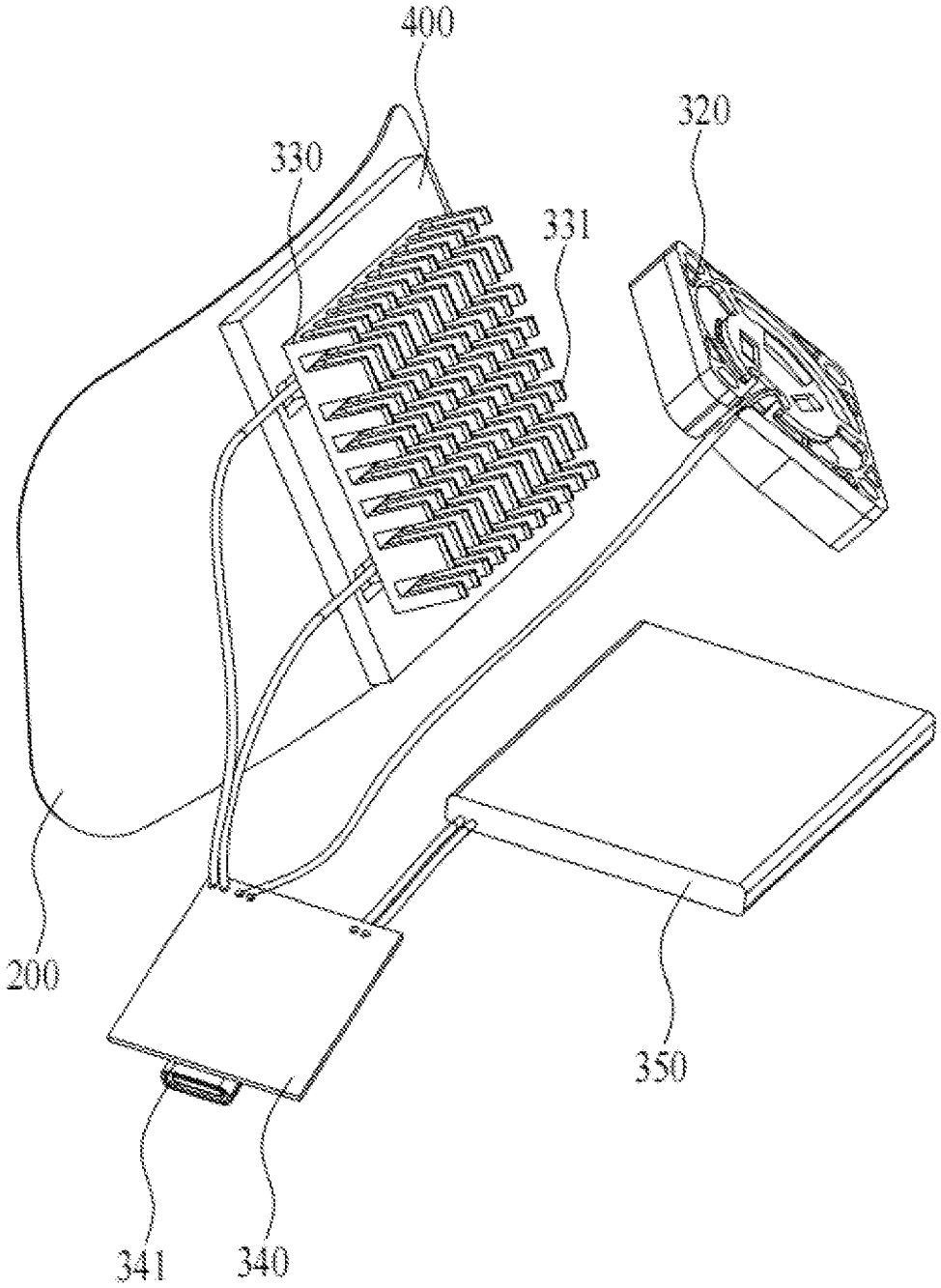
FIG. 4 is a schematic structural diagram of a temperature adjustment assembly according to a first embodiment of the present disclosure.
Figure 5:
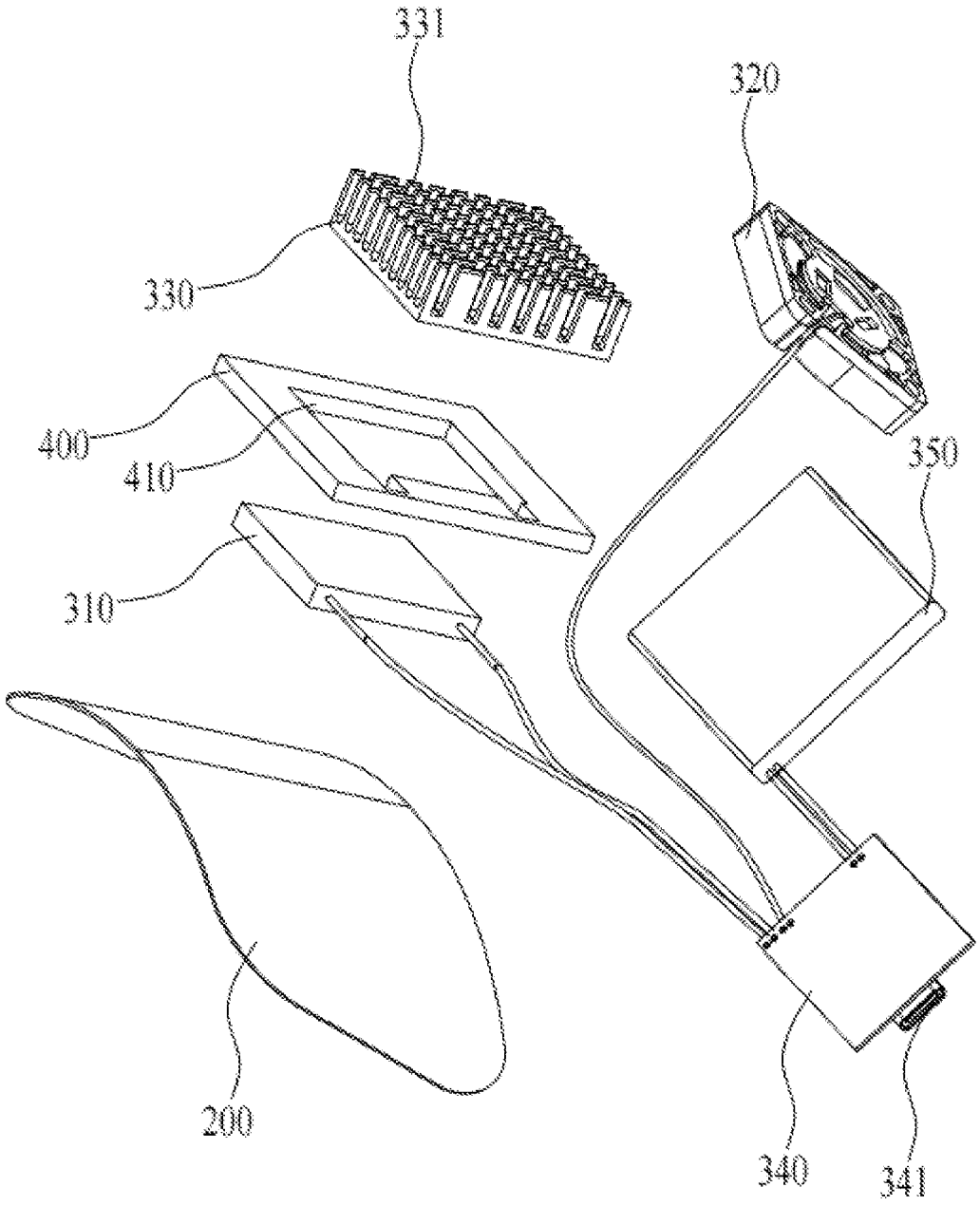
FIG. 5 is a diagram of component disassembly of a temperature adjustment assembly according to a first embodiment of the present disclosure.
Figure 6:
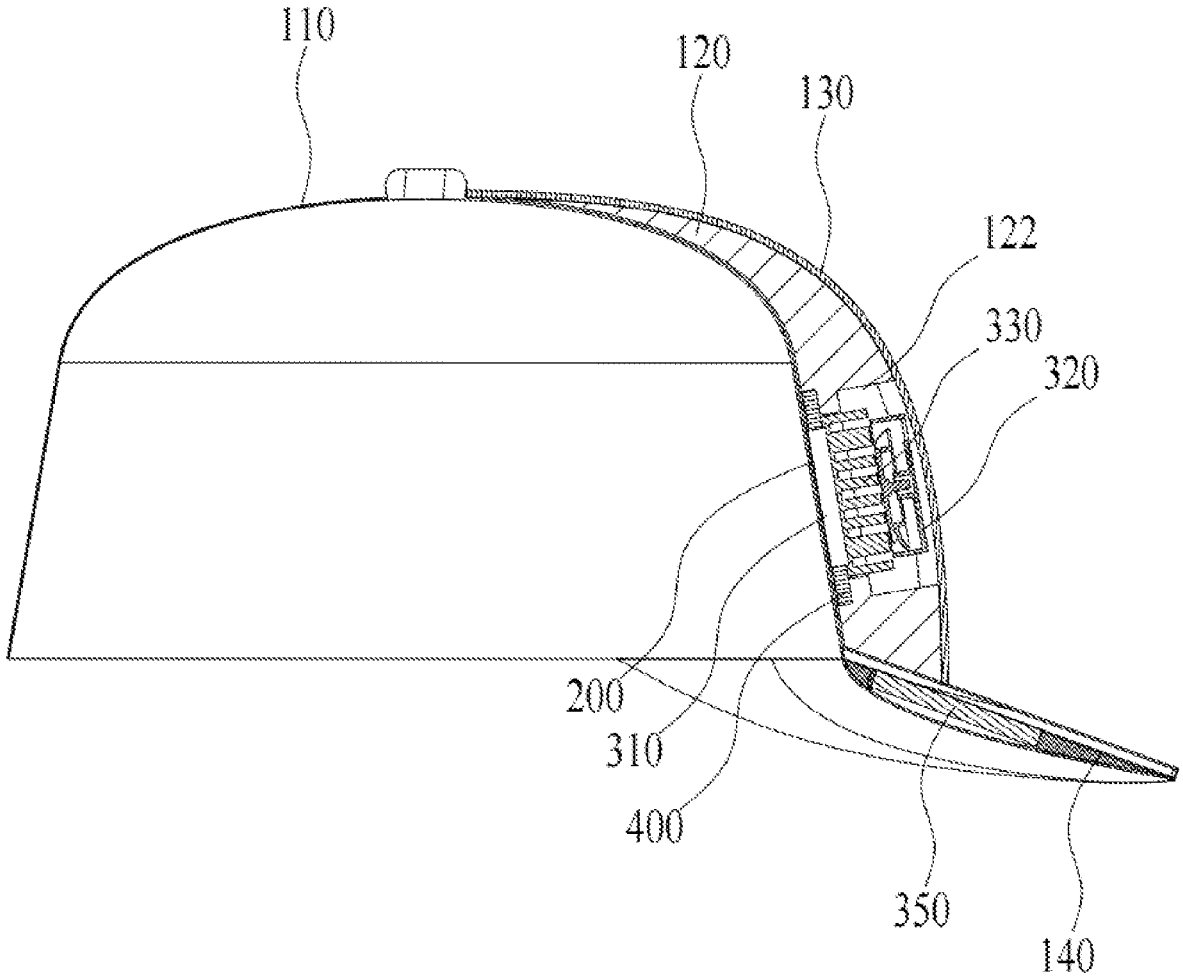
FIG. 6 is a cross-sectional view of a head-mounted temperature adjustment device according to a first embodiment of the present disclosure.

100—Cap body, 110—Cap main body, 120—Filling layer, 121—Avoidance hole, 122—Air inlet groove, 123—First mounting hole, 124—Second mounting hole, 130—Housing, 131—Ventilation structure, 132—Support layer, 133—Breathable layer, 134—Mesh structure, 135—Through hole, 140—Cap peak, 141—First peak layer, 142—Second peak layer, 1421—Limiting hole, 1422—Limiting gap, 143—Third peak layer, 200—Temperature conduction sheet; 300—Temperature adjustment assembly, 310—Semiconductor temperature adjustment member, 320—Fan, 330—Heat dissipation member, 331—Heat dissipation fin, 340—Control circuit board, 341—Charging interface, 342—Switch, 350—Battery, 400—Heat insulation member, and 410—Assembly hole.

DETAILED DESCRIPTION OF THE EMBODIMENTS

The technical solutions of the present disclosure are described in more detail with reference to the accompanying drawings and specific embodiments. Unless otherwise defined, all technical and scientific terms used herein have the same meaning as those commonly understood by a person of skill in the art. The terms used herein are merely intended to describe the specific examples, rather than to limit the present disclosure. In the following description, "some embodiments" means a subset of all possible embodiments. However, it can be understood that "some embodiments" may be a same subset or different subsets of all possible embodiments and may be combined with each other provided that no conflict exists.

It should be noted that, when a component is fixed to another component, the component may be fixed to the other component directly or via an intermediate component. When a component is connected to another component, the component may be connected to the another component directly or via an intermediate component. The terms "vertical", "horizontal", "inside", "outside", "left", "right", and similar terms used herein are just for illustrative purposes, and do not mean sole implementations.

The present disclosure provides a head-mounted temperature adjustment device, which can be used as a sun cap, a decorative cap or a helmet. Refer to FIG. 1 to FIG. 6, in a first embodiment of the present disclosure, the head-mounted temperature adjustment device includes a cap body 100, a temperature conduction sheet 200, and a temperature adjustment assembly 300. The temperature adjustment assembly 300 includes a semiconductor temperature adjustment member 310 and a fan 320, the temperature conduction sheet 200 and the semiconductor temperature adjustment member 310 are thermally conducted and both disposed in the cap body 100, and the fan 320 can be disposed in the cap body 100 or can be disposed on an outer side of the cap body 100. The semiconductor temperature adjustment member 310 may be a TEC semiconductor. During energizing, two opposite sides of the semiconductor temperature adjustment member 310 respectively form a hot surface and a cold surface, and by switching to introduce positive and negative electrodes of a voltage, the cold and hot surfaces of the semiconductor temperature adjustment member 310 can be switched. The temperature conduction sheet 200 is made of a material with high heat conductivity, which may be a graphite sheet, a copper sheet, a graphene sheet or the like. The temperature conduction sheet 200 and the semiconductor temperature adjustment member 310 may be thermally conducted by means of a heat conduction medium, such as heat conduction silica gel, silicon glue and a heat conduction silica gel pad, such that the hot or cold surface of the semiconductor temperature adjustment member 310 can transfer the heat or cold to the temperature conduction sheet 200 with temperature equalization characteristics. The temperature conduction sheet 200 has a shape corresponding to that of the cap body 100, and is disposed on the side of the semiconductor temperature adjustment member 310 facing the human head. During use, the temperature conduction sheet 200 is in contact with the human head, especially the forehead, through the cloth of the cap body 100 to bring the heat or coolness to the human head. The fan 320 is disposed on the side of the semiconductor temperature adjustment member 310 facing away from the human head, and takes away the cold or heat generated by the other side of the semiconductor temperature adjustment member 310 by means of air blowing or air extraction, thereby improving the cold or heat dissipation capability of the semiconductor temperature adjustment member 310, and preventing the cold surface and the hot surface from affecting each other to reduce the heating or refrigeration effect.

In the above solution of the present disclosure, the head-mounted temperature adjustment device can be switched between a cooling mode and a heating mode to warm or cool the human head. When working, the side of the semiconductor temperature adjustment member 310 close to the temperature conduction sheet 200 generates heat or cold and transfers same to the temperature conduction sheet 200 with temperature equalization characteristics, providing uniform cold or heat to the human head and avoiding bad experience of local overcooling or overheating. Specifically, in hot weather, the side of the semiconductor temperature adjustment member 310 facing the human head refrigerates, and evenly transfers the cold to the human head through the temperature conduction sheet 200 to cool the human head, and the fan 320 blows out or extracts the heat generated by the side of the semiconductor temperature adjustment member 310 facing away from the human head to the outside, helping the semiconductor temperature adjustment member to dissipate the heat, such that the semiconductor temperature adjustment member 310 maintains the best cooling effect. In cold weather, the side of the semiconductor temperature adjustment member 310 facing the human head heats, and evenly transfers the heat to the human head through the temperature conduction sheet 200 to warm the human head, and the fan 320 blows out or extracts the cold generated by the side of the semiconductor temperature adjustment member 310 facing away from the human head to the outside, helping the semiconductor temperature adjustment member to dissipate the cold, such that the semiconductor temperature adjustment member 310 maintains the best warming effect. The head-mounted temperature adjustment device of the present disclosure combines the cap body 100 with the temperature conduction sheet 200 and the temperature adjustment assembly 300, such that people can increase or decrease the temperature of the head while wearing the cap.

Refer to FIG. 6 to FIG. 9, as a preferred implementation, the temperature adjustment assembly 300 further includes a heat dissipation member 330 made of a material having high heat conductivity, a plurality of heat dissipation fins 331 are formed on the heat dissipation member 330, and a heat dissipation groove is formed between adjacent heat dissipation fins 331 for increasing an contact area with air. The heat dissipation member 330 is fixed to the side of the semiconductor temperature adjustment member 310 facing away from the temperature conduction sheet 200 by means of bonding or other modes, and is configured to assist the fan 320 to take away the cold or heat generated by the side of the semiconductor temperature adjustment member 310 facing away from the human head. The heat dissipation fins 331 increase the contact area between the heat dissipation member 330 and the air, thereby accelerating the temperature of the side of the semiconductor temperature adjustment member 310 facing away from the temperature conduction sheet 200 to be quickly transferred to the heat dissipation member 330. When the semiconductor temperature adjustment member 310 works, the heat or cold of the side thereof facing away from the temperature conduction sheet 200 is first transferred to everywhere of the heat dissipation member 330, especially the heat dissipation fins 331, and then is effectively taken to the outside by airflow generated by the fan 320. In embodiments shown in the figures, the fan 320 is connected to the heat dissipation member 330 and is hidden in the cap body 100. In other embodiments, the fan 320 may also be mounted on the outer side of the cap body 100 and aligned to the heat dissipation member 330.

Refer to FIG. 2 to FIG. 6 again, as a specific implementation of the present disclosure, the cap body 100 includes a cap main body 110, a filling layer 120 and a housing 130, an avoidance hole 121 configured to accommodate the heat dissipation member 330 is formed in the filling layer 120, a periphery of the housing 130 and the cap main body 110 are connected to fully enclose the filling layer 120, the temperature conduction sheet 200, the semiconductor temperature adjustment member 310 and the heat dissipation member 330, and a ventilation structure 131 is provided at a position of the housing 130 corresponding to the avoidance hole 121, to enable the fan 320 to blow or introduce air.

Optionally, an air inlet groove 122 surrounding the heat dissipation member 330 is formed in the end of the avoidance hole 121 close to the housing 130, and the area of the ventilation structure 131 can cover the avoidance hole 121 and the air inlet groove 122. When the fan 320 rotates, external airflow can enter the fan 320 through the air inlet groove 122, and then is blown out by the fan 320. Or, the filling layer 120 and the housing 130 are both of a breathable structure, such that the fan 320 can directly introduce or discharge air through the filling layer 120 and the housing 130, the airflow flows more smoothly, and the heat or cold dissipation efficiency is improved. The filling layer 120 may be made of a porous light material such as sponge and foam, and the filling layer 120 is mainly configured to shield and limit the temperature conduction sheet 200, the semiconductor temperature adjustment member 310 and the heat dissipation member 330 to avoid exposure of these elements to affect the beauty of the head-mounted temperature adjusting device. The housing 130 may be made of breathable cloth, and the housing 130 is configured to shield the filling layer 120 and fix the filling layer 120, the temperature conduction sheet 200, the semiconductor temperature adjustment member 310 and the heat dissipation member 330 on the cap main body 110. In the embodiments shown in the figures, the fan 320 is also hidden in the avoidance hole 121 and is matched with the filling layer 120, and the thickness of the filling layer 120 needs to be sufficient to accommodate both the heat dissipation member 330 and the fan 320. In other embodiments, the fan 320 may also be mounted on the side of the housing 130 facing away from the filling layer 120, such that the thickness of the filling layer 120 can be reduced.

Figure 7:
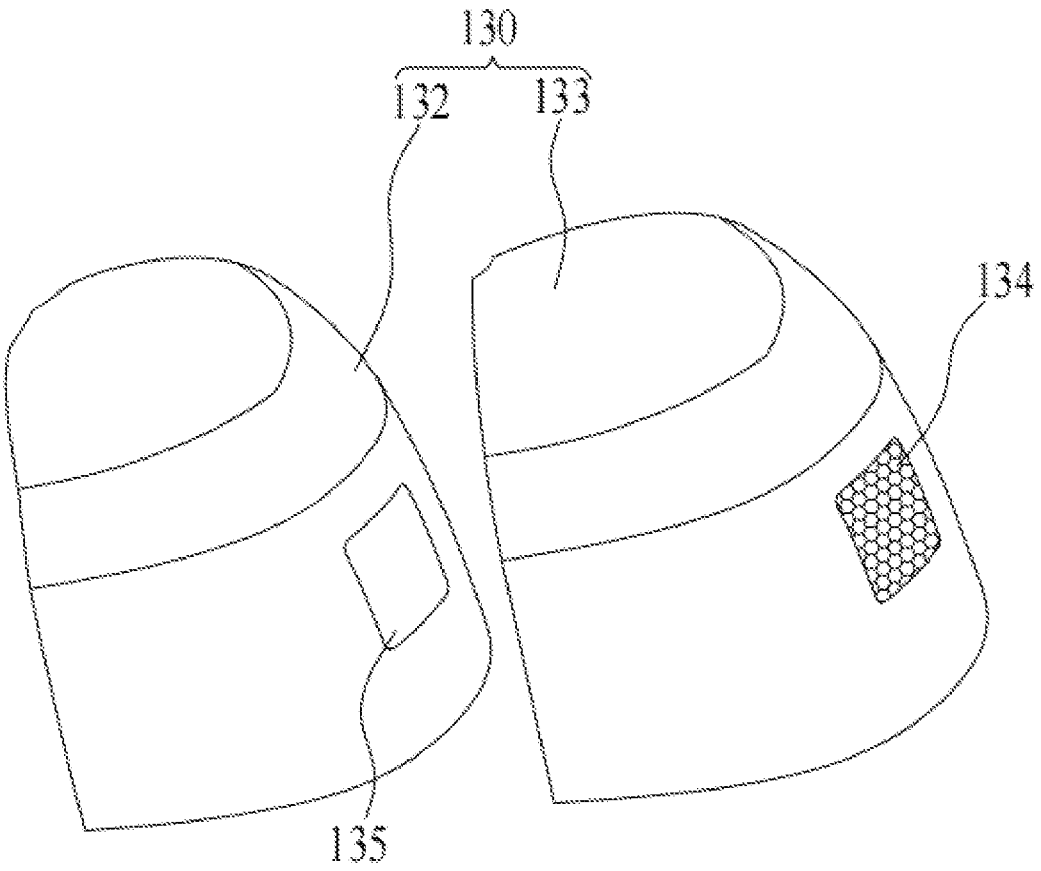
FIG. 7 is a schematic diagram of disassembly of a housing according to a first embodiment of the present disclosure.
Figure 8:
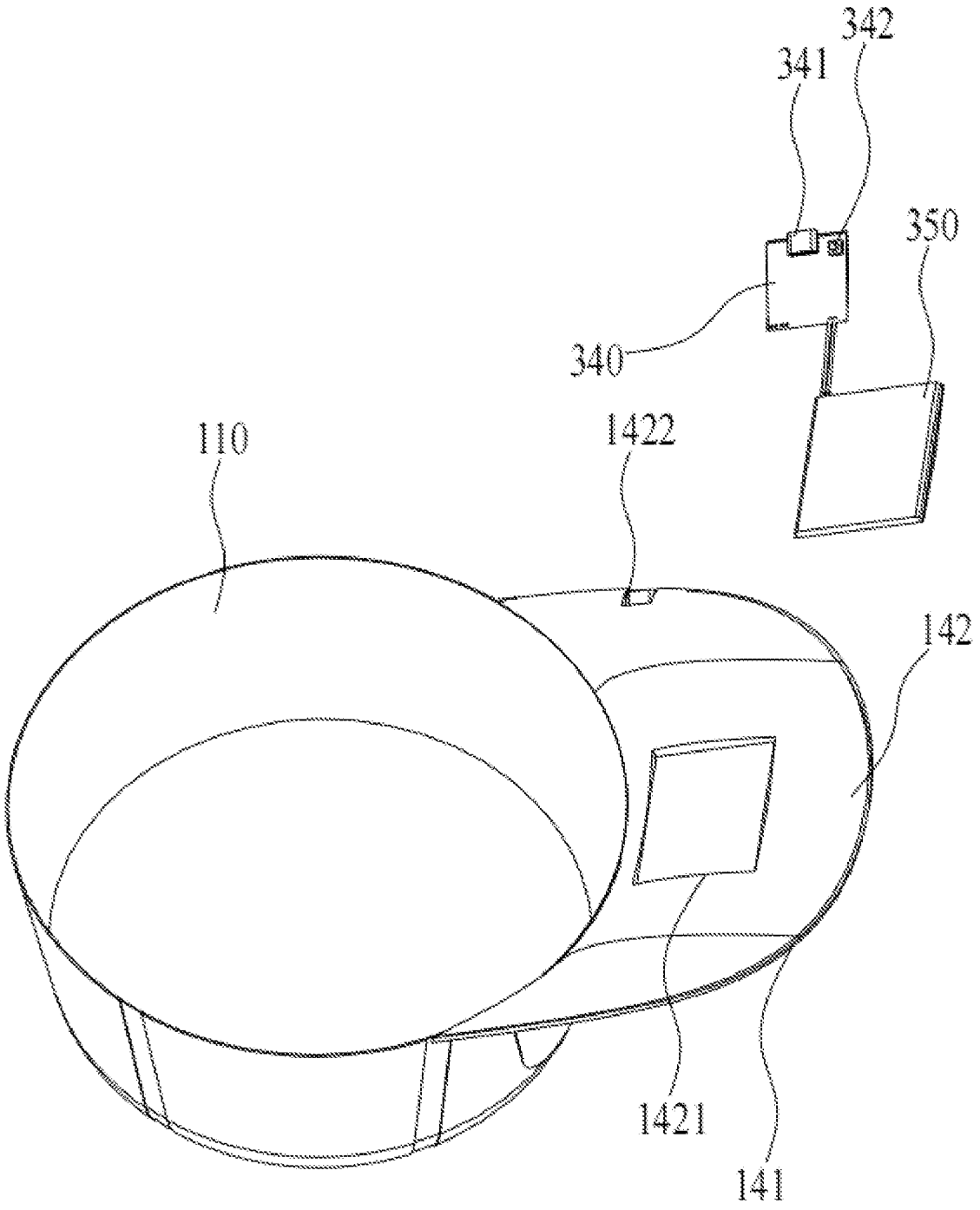
FIG. 8 is a schematic structural diagram of a cap peak in a head-mounted temperature adjustment device according to a first embodiment of the present disclosure.
Figure 9:
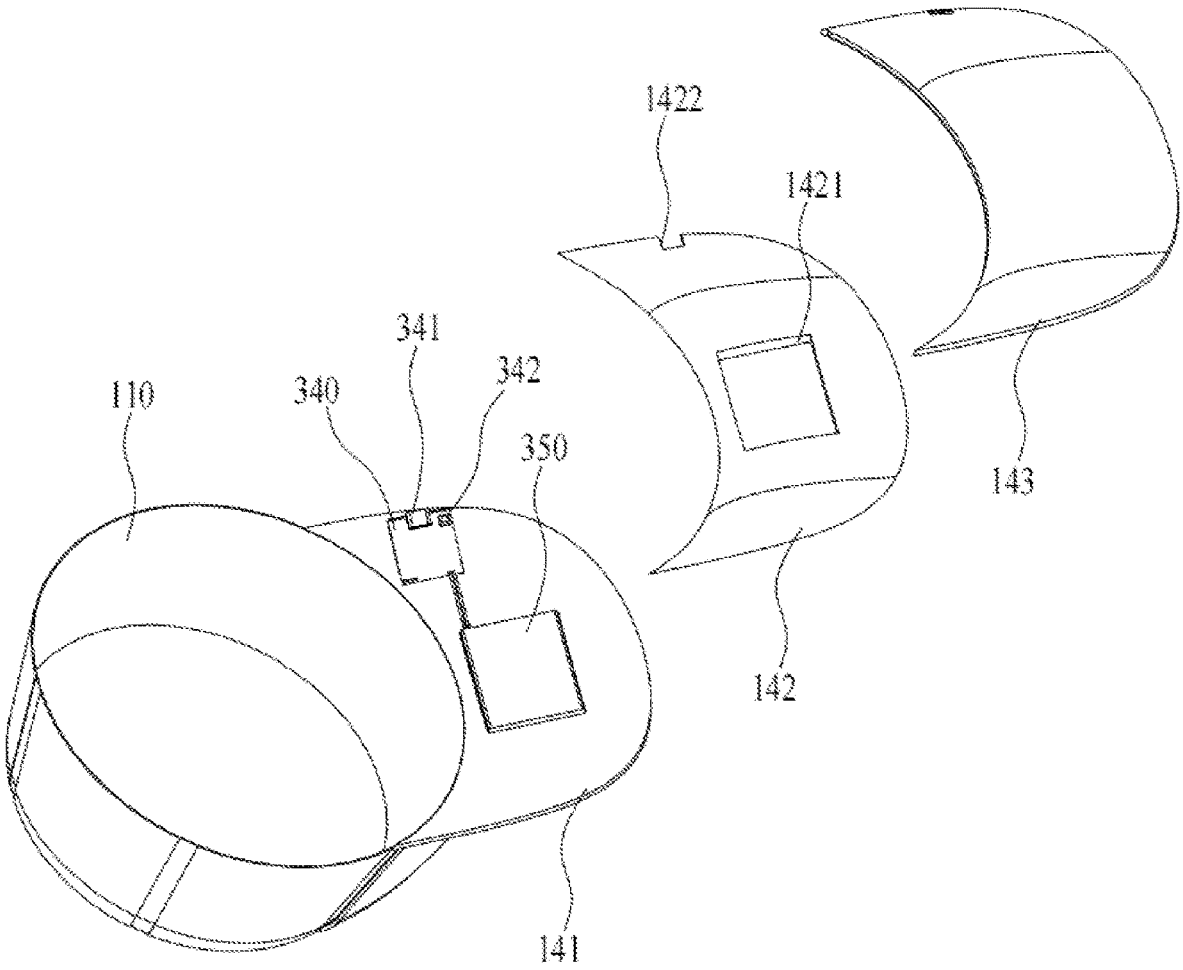
FIG. 9 is another schematic structural diagram of a cap peak in a head-mounted temperature adjustment device according to a first embodiment of the present disclosure.

Refer to FIG. 7, furthermore, the housing 130 may be of a double-layer structure. An inner layer is a support layer 132, which is made of plastic having fine holes or hard cloth, and has a certain rigidity. An outer layer is a breathable layer 133, which is made of sparse breathable cloth, and has breathability. The support layer 132 is close to the filling layer 120 relative to the breathable layer 133. The ventilation structure 131 includes a through hole 135 formed in the support layer 132 and a mesh structure 134 provided on the breathable layer 133. The breathable layer 133 may be locally mesh-shaped corresponding to the through hole 135, or may be entirely mesh-shaped. The mesh structure 134 can ensure a beautiful appearance and facilitate the fan 320 to bring the airflow out to the outside.

Refer to FIG. 5 to FIG. 9, as an optional implementation of the present disclosure, the temperature adjustment assembly 300 includes a control circuit board 340 and a battery 350, and the semiconductor temperature adjustment member 310, the fan 320 and the battery 350 are electrically connected to the control circuit board 340, respectively. The cap body 100 may further include a cap peak 140, and the control circuit board 340 and the battery 350 are disposed in the cap peak 140. The battery 350 is configured to supply energy to the fan 320 and the semiconductor temperature adjustment member 310, and the control circuit board 340 is provided with a switch 342 configured to control start and stop of the fan 320 and the semiconductor temperature adjustment member 310. In embodiments shown in the figures, the cap body 100 is similar to a peaked cap. The control circuit board 340 and the battery 350 are flat-shaped and therefore hidden within the cap peak 140. The temperature conduction sheet 200, the semiconductor temperature adjustment member 310, the heat dissipation member 330 and the like are hidden in the filling layer 120 at the cap top, and are electrically connected to the control circuit board 340 through electric wires. Through this split arrangement, the overall volume of the cap body 100 can be effectively reduced, and the beauty of the cap body 100 can be improved. In other implementations, power can also be supplied through an external power supply.

When working, the positive and negative electrodes of the TEC semiconductor temperature adjustment member 310 are powered by the battery 350 and the control circuit board 340. In a refrigeration mode, the positive electrode of the semiconductor temperature adjustment member 310 is connected to the positive electrode of the control circuit board 340, and the negative electrode of the semiconductor temperature adjustment member 310 is connected to the negative electrode of the control circuit board 340 to achieve cold-hot separation. That is, the cold surface continuously generates the cold, and the hot surface continuously generates the heat. Then, the cold is transferred to the temperature conduction sheet 200 through heat conduction silicone grease or a heat conduction silica gel pad, and then a large-area refrigeration and temperature homogenization effect is achieved through the temperature conduction sheet 200 with high heat conductivity. The heat on the other side of the semiconductor temperature adjustment member 310 is quickly adsorbed by the heat dissipation member 330, and flowing air generated when the fan 320 is started takes away the heat of the heat dissipation member 330, thereby stabilizing the temperature of the heat dissipation member 330 within a normal range, and ensuring that the semiconductor temperature adjustment member 310 has a better heat dissipation capability. The operations are continuously circulated to achieve refrigeration. It should be noted that if in the cooling mode, the heat generated by the TEC semiconductor temperature adjustment member 310 cannot be taken away in time to achieve cold-heat balance, the cold surface is also affected by the hot surface to gradually become hotter, thereby losing the cooling effect.

Similarly, in the heating mode, the positive electrode of the semiconductor temperature adjustment member 310 is connected to the negative electrode of the control circuit board 340, and the negative electrode of the semiconductor temperature adjustment member 310 is connected to the positive electrode of the control circuit board 340, such that the original cold surface continuously generates the heat, and the original hot surface continuously generates the cold. Then, the heat is transferred to the temperature conduction sheet 200 through heat conduction silicone grease or a heat conduction silica gel pad, and then a large-area heating and temperature homogenization effect is achieved through the temperature conduction sheet 200 with high heat conductivity. The cold on the other side of the semiconductor temperature adjustment member 310 is quickly adsorbed by the heat dissipation member 330, and flowing air generated when the fan 320 is started takes away the cold of the heat dissipation member 330, thereby stabilizing the temperature of the heat dissipation member 330 within a normal range, and ensuring that the semiconductor temperature adjustment member 310 has a better cold dissipation capability. The operations are continuously circulated to achieve heating.

Furthermore, the cap peak 140 includes a first peak layer 141, a second peak layer 142 and a third peak layer 143, the second peak layer 142 is provided with a limiting hole 1421 matched with the battery 350, and the first peak layer 141 and the third peak layer 143 are connected to fully enclose the second peak layer 142, the control circuit board 340 and the battery 350. The control circuit board 340 can be sandwiched between the first peak layer 141 and the second peak layer 142, and can also be sandwiched between the second peak layer 142 and the third peak layer 143. The first peak layer 141 can be made of hard plastic sheet or hard cloth, and is configured to support the whole cap peak 140. The second peak layer 142 can be made of soft cloth or sponge to play a filling role, create an accommodating space for the thicker battery 350, and facilitate the mounting of the battery 350. The third peak layer 143 can be made of soft cloth, the periphery of the third peak layer 143 is stitched with the first peak layer 141 to fix the control circuit board 340 and the battery 350 in the cap peak 140, and one end of the cap peak 140 is stitched together with the cap main body 110. In other implementations, the cap peak 140 may also be of a double-layer or four-layer structure, as long as it can be perfectly hidden in a related component.

Furthermore, a charging interface 341 is provided at one end of the control circuit board 340, the charging interface 341 is located at an edge of the cap peak 140, and the second peak layer 142 is provided with a limiting gap 1422 matched with the charging interface 341 for fixing the charging interface 341 at the edge of the cap peak 140. The charging interface 341 may be connected to a charging wire for charging and energy storage for the battery 350.

Preferably, the temperature conduction sheet 200 may extend along the circumferential direction of the cap main body 110 in an arc shape, and abut against the cap main body 110. On the one hand, the arc-shaped temperature conduction sheet 200 is matched with the cap main body 110 in shape, and on the other hand, it can fit well with the human head to transfer the temperature. Furthermore, the head-mounted temperature adjustment device further includes a heat insulation member 400, where the heat insulation member 400 is sleeved on a periphery of the semiconductor temperature adjustment member 310. The heat insulation member 400 may be made of an aerogel material or other materials with better heat insulation properties. The heat insulation member 400 is provided with an assembly hole 410 in the middle for cooperating with the semiconductor temperature adjustment member 310. By sleeving the heat insulation member 400 on the periphery of the semiconductor temperature adjustment member 310, temperature exchange between the cold surface and the hot surface of the semiconductor temperature adjustment member 310 can be effectively avoided.

Figure 10:
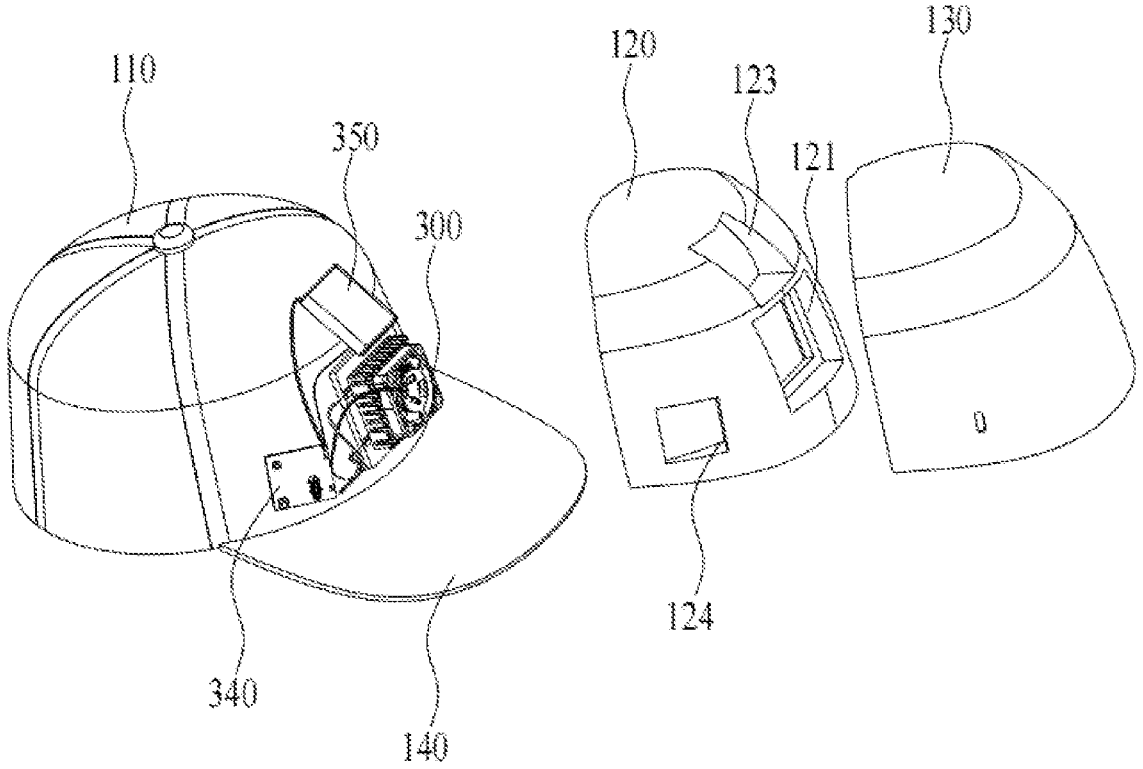
FIG. 10 is a schematic diagram of cap body disassembly of a head-mounted temperature adjustment device according to a second embodiment of the present disclosure.
Figure 11:
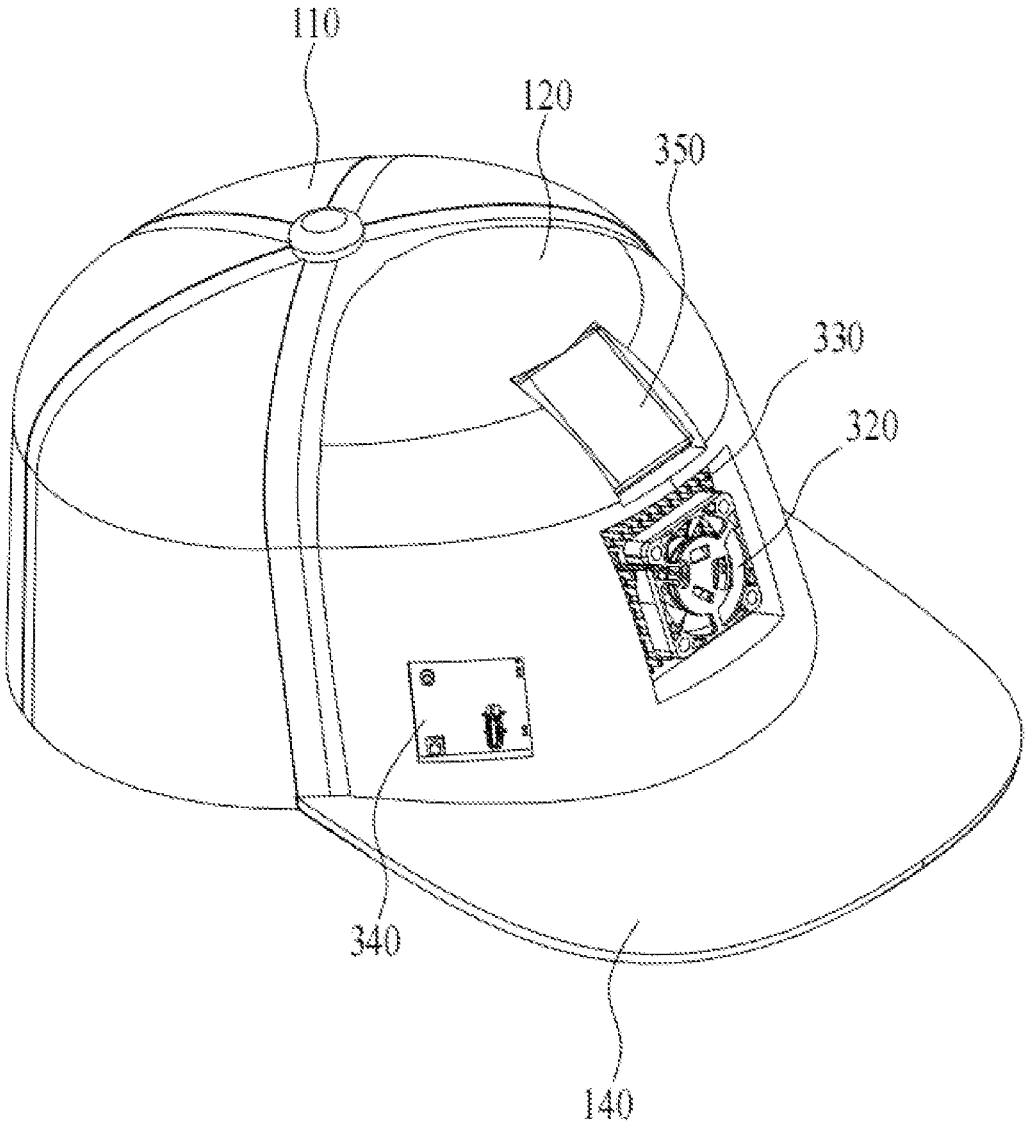
FIG. 11 is a schematic diagram of some structures of a head-mounted temperature adjustment device according to a second embodiment of the present disclosure.

Refer to FIG. 10 and FIG. 11, in a second embodiment of the present disclosure, the control circuit board 340 and the battery 350 are not disposed in the cap peak 140, but are disposed in the filling layer 120 of the cap body 100. Specifically, the filling layer 120 is provided with a first mounting hole 123 for cooperating with the battery 350 and a second mounting hole 124 for cooperating with the circuit board 340, and the first mounting hole 123 and the second mounting hole 124 are respectively located on different sides of the avoidance hole 121. Compared with the first embodiment, the second embodiment does not require the cap peak 140 and can adapt to more types of cap body structures.

The above described are merely specific implementations of the present disclosure, and the protection scope of the present disclosure is not limited thereto. Any modification or replacement easily conceived by those skilled in the art within the technical scope of the present disclosure should fall within the protection scope of the present disclosure. Therefore, the protection scope of the present disclosure shall be the protection scope of the claims.

What is claimed is:

1. A head-mounted temperature adjustment device, comprising a cap body, a temperature conduction sheet, and a temperature adjustment assembly, wherein the temperature adjustment assembly comprises a semiconductor temperature adjustment member and a fan, the temperature conduction sheet and the semiconductor temperature adjustment member are thermally conducted and both disposed in the cap body, the temperature conduction sheet is located on a side of the semiconductor temperature adjustment member facing a human head, and the fan is disposed on a side of the semiconductor temperature adjustment member facing away from the human head.

2. The head-mounted temperature adjustment device according to claim 1, wherein the temperature adjustment assembly further comprises a heat dissipation member, a plurality of heat dissipation fins are formed on the heat dissipation member, the heat dissipation member is disposed on a side of the semiconductor temperature adjustment member facing away from the temperature conduction sheet, and the fan is connected to the heat dissipation member or the cap body.

3. The head-mounted temperature adjustment device according to claim 2, wherein the cap body comprises a cap main body, a filling layer and a housing, an avoidance hole configured to accommodate the heat dissipation member is formed in the filling layer, a periphery of the housing and the cap main body are connected to fully enclose the filling layer, the temperature conduction sheet, the semiconductor temperature adjustment member and the heat dissipation member, and a ventilation structure is provided at a position of the housing corresponding to the avoidance hole.

4. The head-mounted temperature adjustment device according to claim 3, wherein the temperature adjustment assembly comprises a control circuit board and a battery, and the semiconductor temperature adjustment member, the fan and the battery are electrically connected to the control circuit board, respectively.

5. The head-mounted temperature adjustment device according to claim 4, wherein the cap body further comprises a cap peak, the cap peak comprises a first peak layer, a second peak layer and a third peak layer, the second peak layer is provided with a limiting hole matched with the battery, and the first peak layer and the third peak layer are connected to fully enclose the second peak layer, the control circuit board and the battery.

6. The head-mounted temperature adjustment device according to claim 5, wherein a charging interface is provided at one end of the control circuit board, the charging interface is located at an edge of the cap peak, and the second peak layer is provided with a limiting gap matched with the charging interface.

7. The head-mounted temperature adjustment device according to claim 3, wherein the filling layer and the housing are both of a breathable structure, or an air inlet groove surrounding the heat dissipation member is formed in one end of the avoidance hole close to the housing.

8. The head-mounted temperature adjustment device according to claim 7, wherein the housing comprises a support layer and a breathable layer, the support layer is close to the filling layer relative to the breathable layer, and the breathable layer is locally or entirely of a mesh structure.

9. The head-mounted temperature adjustment device according to claim 3, wherein the temperature conduction sheet extends along a circumferential direction of the cap main body in an arc shape, and abuts against the cap main body.

10. The head-mounted temperature adjustment device according to claim 3, further comprising a heat insulation member, wherein the heat insulation member is sleeved on a periphery of the semiconductor temperature adjustment member.

* * * * *